US006078770A

United States Patent [19]

Watabe et al.

[11] Patent Number: 6,078,770

[45] Date of Patent: Jun. 20, 2000

[54] TONER-AMOUNT REGULATING ELASTIC BLADE AND DEVELOPING DEVICE AND APPARATUS UNIT USING THE SAME

[75] Inventors: Masahiro Watabe, Yokohama; Kentaro Niwano, Yamato, both of Japan

[73] Assignee: Canon Kabushiki Kaisha, Tokyo, Japan

[21] Appl. No.: 09/069,248

[22] Filed: Apr. 29, 1998

[30] Foreign Application Priority Data

May 7, 1997 [JP] Japan ..... 9-116917

[51] Int. Cl.[7] ..... G03G 15/08

[52] U.S. Cl. ..... 399/284

[58] Field of Search ..... 399/274, 284, 399/273, 283, 350, 351

[56] References Cited

U.S. PATENT DOCUMENTS

| | | | |
|---|---|---|---|
| 3,859,691 | 1/1975 | Katayama et al. | 399/351 X |
| 4,469,434 | 9/1984 | Yamazaki et al. | 399/351 |
| 4,498,760 | 2/1985 | Sugiyama | 399/351 |
| 4,568,175 | 2/1986 | Inowa et al. | 399/351 |
| 4,939,551 | 7/1990 | Hashiyama et al. | 399/351 |
| 5,237,375 | 8/1993 | Michlin et al. | 399/274 |
| 5,353,104 | 10/1994 | Kato et al. | 399/274 |
| 5,587,776 | 12/1996 | Watabe et al. | 399/284 |
| 5,713,120 | 2/1998 | Watabe et al. | 29/527.4 |
| 5,722,021 | 2/1998 | Iwao | 399/284 |
| 5,729,806 | 3/1998 | Niwano et al. | 399/284 |

*Primary Examiner*—Susan S. Y. Lee

*Attorney, Agent, or Firm*—Fitzpatrick, Cella, Harper & Scinto

[57] ABSTRACT

A high-precision injection-molded toner-amount regulating elastic blade used for high-quality development, particularly, an elastic blade in which the generation of rust is prevented by suppressing peeling of a plated layer from a supporting plate, is provided. The elastic blade is used in an image forming apparatus in which an electrostatic latent image formed on an image bearing member is developed using a toner to provide a visual image. A preserved steel plate obtained by plating a zinc alloy on surfaces of an iron material is used as the supporting plate. A rubber elastic member for regulating the amount of the toner is supported on the supporting plate.

10 Claims, 2 Drawing Sheets

TONER-AMOUNT REGULATING ELASTIC BLADE AND DEVELOPING DEVICE AND APPARATUS UNIT USING THE SAME

BACKGROUND OF THE INVENTION

1. Field of the Invention

The present invention relates to a toner-amount-regulating elastic blade which regulates the amount of a toner for developing an electrostatic latent image formed on an image bearing member in order to provide a visual image, and a developing device and an apparatus unit using such a blade.

2. Description of the Related Art

An elastic blade comprising a supporting plate and a rubber elastic member supported thereon is known as an elastic blade for regulating the amount of a toner coated on the surface of a toner bearing member.

FIG. 2 illustrates a developing device using such an elastic blade. This developing device includes a toner bearing member mounted in a toner chamber 2, a toner-amount regulating elastic blade 4, an elastic roller 5, and a toner 6. An electrophotographic photosensitive member 1 faces the toner bearing member 3 with a very small gap therebetween. The toner bearing member 3 carries the toner 6 to a developing portion. By contacting the elastic blade 4, which serves as means for regulating the thickness of the layer of the toner 6 on the toner bearing member 3 to a thin value, to the toner bearing member 3, and regulating the toner 6 passing through a contact portion between the elastic blade 4 and the toner bearing member 3, a thin layer of the toner 6 is formed on the toner bearing member 3. The toner 6 is provided with triboelectric charges for developing a latent image by friction at the contact portion. The elastic blade 4 includes a supporting plate 4a and an elastic member 4*b* supported thereon.

A rubber plate, a metallic thin plate, a resin thin plate, a lamination of these plates, or the like has been proposed as the elastic member 4*b*.

For example, a zinc-plated preserved steel plate processed by pressing, or a metallic foil of stainless steel, phosphor bronze or the like is used as the supporting plate 4*a* of the elastic blade 4. A charge provision layer made of silicone rubber, urethane rubber or the like subjected to charge control is laminated on the entirety or a part of the surface of the supporting plate 4*a* by bonding, multicolor forming or the like.

In order to provide a high-quality image or a full-color image by applying an electrophotographic process, for example, the particle size of the toner must be reduced, and more uniform pressure contact with the toner bearing member is required. However, in the conventional elastic blade, there is nonuniform pressure contact in the longitudinal direction of the toner bearing member, resulting in nonuniform charge and, hence, toner having a nonuniform thickness being applied thereto. As a result, a nonuniform image or an image imperfection, such as stripes in an image, or the like, tends to occur.

In order to provide a very precise elastic blade capable of providing uniform pressure contact, there has been an attempt to prepare a supporting plate comprising a steel plate 1.2–1.6 mm thick having a sufficient strength so as not to be deformed when it is mounted in a developing device, and bonding a rubber sheet so that it protudes from a part of the supporting plate. Also, an attempt has been made to form an integrally molded blade by performing injection molding of rubber and inserting the supporting plate. Zinc is plated on the surface of the supporting plate in order to prevent the plate from rusting. A more precise elastic blade can be obtained by performing integral molding than by bonding a rubber sheet. However, when an integrally molded blade is manufactured by performing injection molding of rubber and inserting the supporting plate, the supporting plate is, in some cases, deformed due to the pressure during injection. In order to prevent such a problem, a method of performing injection molding by inserting the plate between molds has been attempted. In this case, however, there is the problem that, when the supporting plate is inserted between molds, the zinc-plated layer of the plate is peeled from the iron surface of the base material due to the surface pressure of the molds and adheres to the molds. If the molding of blades is continued using these molds, the amount of plated layers adhering to the molds increases, thereby causing rubber burr during molding and a change in the size of the molded product. Accordingly, it is necessary to clean the molds.

Furthermore, it has become clear that, since plated zinc on the supporting plate of the molded elatic blade is, thus exposing iron of the base material directly to atmospheric air, rust is generated after assembling the elastic blade in an image forming apparatus. When rust has been generated, the rust leaves the mounted position in the developing device, and is magnetically attracted and fixed on the toner bearing member having a magnet roller incorporated therein which is present near the elastic blade. Particularly, when the rust is attracted on an image developing region, an imperfect image, such as uneven development, stripes or the like, will occur in a developed image on the photosensitive member during development. Even if the toner bearing member does not use a magnet roller, a failure in an image will occur due to adherence of the rust to the developing portion.

SUMMARY OF THE INVENTION

It is an object of the present invention to provide an elastic blade in which a plated layer on a supporting plate is hardly peeled, so that the generation of rust causing a nonuniform image or stripes in an image can be prevented.

It is another object of the present invention to provide a developing device and an apparatus unit using such an elastic blade.

According to one aspect, the present invention which achieves these objectives relates to a toner-amount regulating elastic blade for regulating an amount of a toner coated on a surface of a toner bearing member. The elastic blade includes a supporting plate and a rubber elastic member. The supporting plate is made of an iron material having a zinc-alloy plated layer on surfaces thereof.

According to another aspect, the present invention which achieves these objectives relates to a developing device including a receptacle for accommodating a toner, a toner bearing member for carrying the toner within the receptacle to a developing portion, and an elastic blade for regulating an amount of the toner coated on the toner bearing member. The elastic blade includes a supporting plate and a rubber elastic member. The supporting plate is made of an iron material having a zinc-alloy plated layer on surfaces thereof.

According to still another aspect, the present invention which achieves these objectives relates to an apparatus unit including at least a photosenstive member and developing means. The photosensitive member and the developing means are integrated so as to be mountable/detachable with respect to a main body of an electrophotographic apparatus. The developing means includes a receptacle for accommodating a toner, a toner bearing member for carrying the toner within the receptacle to a developing portion, and an elastic blade for regulating an amount of the toner coated on the toner bearing member. The elastic blade includes an iron supporting plate having a zinc-alloy plated layer on surfaces thereof, and a rubber elastic member.

According to the present invention, by changing the material for the plated layer of the supporting plate from electroplated zinc to a plated zinc alloy, it is possible to provide a very precise elastic blade in which the plated layer is not peeled even if the supporting plate is placed in pressure contact with molds at a high temperature.

According to the present invention, by adopting a zinc-alloy plated layer as a preserving plated layer of the supporting plate, it is possible to provide an elastic blade which does not degrade an image even in development in a high-humidity environment.

DESCRIPTION OF THE PREFERRED EMBODIMENTS

A zinc-nickel alloy or a zinc-iron alloy is suitable as a zinc alloy used for surface plating processing of a supporting plate of an elastic plate according to the present invention.

A zinc-nickel-alloy plated layer is formed by electroplating. A zinc-iron alloy layer is provided by inmersing an iron plate in a fused zinc bath to form a zinc plated layer, and then forming an alloy with iron on the surface of the iron plate by heating the layer.

Figure 1:
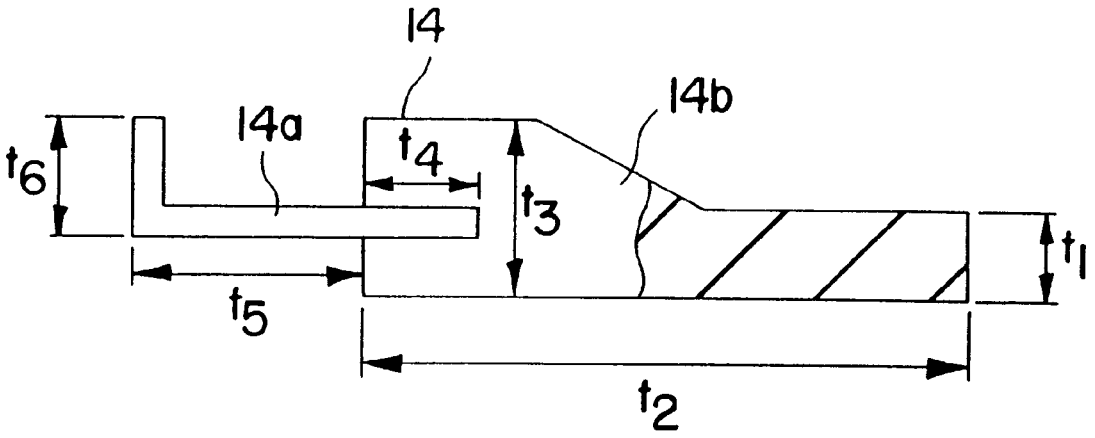
FIG. 1 is a schematic side view illustrating an example of the shape of a toner-amount regulating elastic blade according to the present invention.
Figure 2:
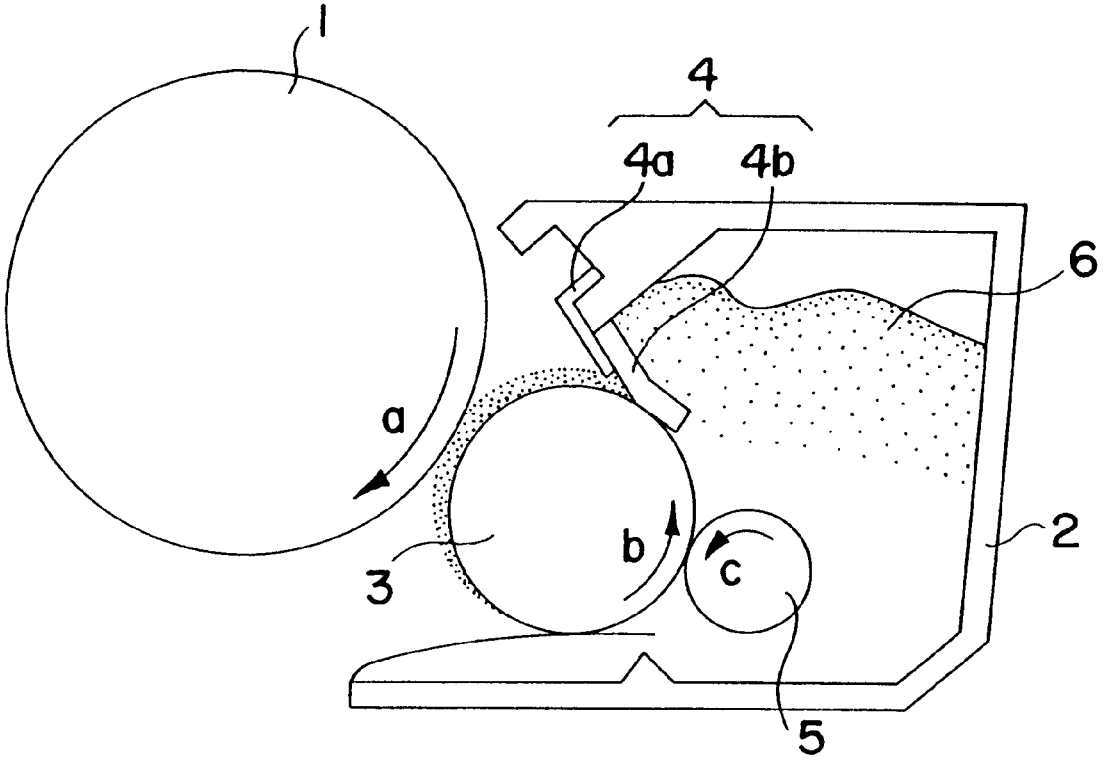
FIG. 2 is a schematic diagram illustrating a conventional image forming apparatus.

FIG. 1 illustrates an elastic blade 14 according to the present invention. The elastic blade 14 includes a rubber elastic member 14*b* integrally molded with a supporting plate 14*a* so that the rubber elastic member 14*b* surrounds a part of the supporting plate 14*a*. When integrally molding the rubber elastic member with the supporting plate, the bonding strength between iron of the base material and the zinc-alloy plated layer tends to decrease as the temperature of molds during molding increases. Hence, it is preferable to use a plate which exhibits a smaller decrease in bonding strength and which maintains a sufficient bonding strength at the pressure during molding. For example, a "Zinclite" steel plate ZLC (trade name)" subjected to zinc-nickel alloy plating processing made by Nippon Steel Corporation, or a "Silveralloy ASHC (trade name)" subjected to zinc-iron alloy plating processing made by Nippon Steel Corporation is preferable as the above-described preserved supporting plate, because the plated layer is hardly peeled from the iron even if the supporting plate is inserted between molds maintained at a high temperature by applying pressure. The thickness of the supporting plate is preferably about 1.2–1.6 mm from the viewpoint of the strength and pressability. The amount of the plated layer adhering to each surface is preferably 10–50 g/m$^2$. The surfaces of the supporting plate may be subjected to chromate treatment.

The supporting plate is simultaneously subjected to shearing punching, bending, and reference-hole punching by metal press working. After performing degreasing cleaning of the supporting plate, an adhesive is coated on a portion of the supporting plate where the rubber elastic layer is to be bonded. After drying and baking the coated adhesive, the supporting plate is inserted between molds heated to a desired temperature, and rubber for the rubber elastic member is subjected to injection molding.

A rubber having a JIS (Japanese Industrial Standards) A hardness equal to or less than 80 degrees is preferably used for the rubber elastic member. Although any appropriate injection moldable silicone rubber, such as an HTV mirable rubber, an LTV liquid silicone rubber or the like, may be used, an LTV liquid silicone rubber is preferable from the viewpoint of adaptability to injection molding.

As descibed above, when performing integral injection molding, an adhesive for bonding rubber on the supporting plate, i.e., a primer, is coated on the supporting plate before molding. A silicone coupling agent, a titanium coupling agent, or a mixture of silicate agents is used as such a primer. The primer is processed in the following manner. That is, after performing sufficient degreasing cleaning of the surface of the supporting plate using a solvent, an appropriate amount of primer is coated at a portion where rubber is to be bonded by spraying the primer or using a brush, a sponge or the like. After drying and baking the coated primer, the supporting plate is inserted between molds.

Injection molding is performed in the following manner. That is, a liquid silicone rubber material, including a main agent and a curing agent containing curing-agent components, is stirred by a static stirrer, such as a static mixer or the like, while being conveyed to an injection molding machine (LIM or LIMS molding machine). The liquid silicone rubber material is fed to an injection cylinder of the injection molding machine, and is injected from the injection cylinder into molds heated in advance to a predetermined temperature where the supporting plate has been inserted in advance. The temperature of the molds is about 100° C.–220° C., and is preferably at least 150° C. in order to shorten the molding time.

In order to prevent the deformation of the supporting plate and the generation of barr due to the injection pressure, the surface pressure when inserting the supporting plate between the molds is preferably 20–200 kg/cm$^2$, compared to the injection pressure of 100–1,000 kg/cm$^2$.

A typical developing device using the elastic blade according to the present invention includes a chamber for accommodating a toner, a toner bearing member for carrying the toner within the chamber to a developing portion, and an elastic blade for regulating the amount of the toner coated on the toner bearing member.

Figure 3:
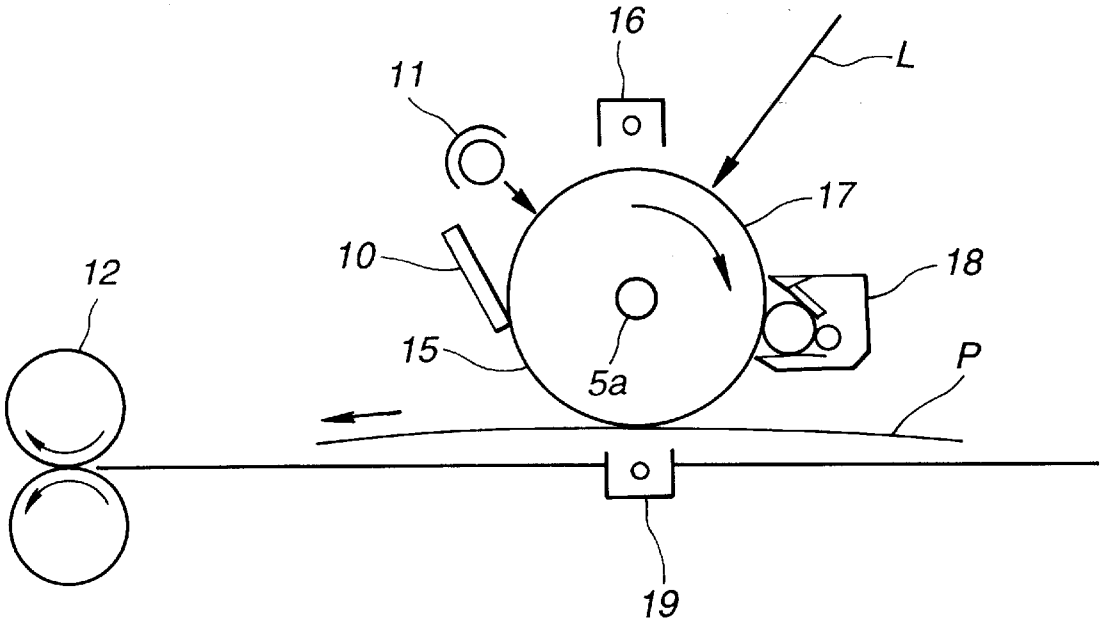
FIG. 3 is a schematic diagram illustrating an image forming apparatus using the elastic blade of the present invention.

FIG. 3 is a schematic diagram illustrating the configuration of an image forming apparatus using the elastic blade of the invention.

In FIG. 3, a photosensitive member 15 is rotatably driven around a shaft 5*a* in the direction of an arrow at a predetermined circumferential speed. While being rotated, the circumferential surface of the photosensitive member 15 is uniformly charged to a predetemined positive or negative potential by charging means 16, and is then subjected to image exposure L (slit exposure, laser-beam scanning exposure or the like) by image exposure means (not shown) at an exposure portion 17. Thus, an electrostatic latent image corresponding to the image exposure is sequentially formed on the circumferential surface of the photosensitive member 15.

Then, the electrostatic latent image is developed by the toner by developing means 18. The developed toner image is sequentially transferred by transfer means 19 onto the surface of a recording material P fed from a sheet feeding unit (not shown) to a portion between the photosensitive member 15 and the transfer means 19 in synchronization with the rotation of the photosensitive member 15. The recording material P having the image transferred thereto is separated from the surface of the photosensitive member 15, then guided to image fixing means 12 to be subjected to image fixing, and discharged to the outside of the apparatus as a copy. After the image transfer, the surface of the photosensitive member 15 is cleaned by removing remaining toner particles by cleaning means 10, then subjected to charge removing processing by pre-exposure means 11, and thereafter repeatedly used for image formation.

A corona charging device or a direct charging device using a conductive roller is used as the charging means 16. Corona transfer means or direct charging means using a conductive roller is used as the transfer means 19.

A plurality of components from among those comprising at least the photosensitive member, the developing means, the cleaning means and the like may be integrally combined as an apparatus unit, and the apparatus unit may be mountable/detachable with respect to the main body of the apparatus. For example, the photosensitive member 15 and the developing means 18 may be integrated as an apparatus unit, and this apparatus unit may be mountable/detachable using guide means, such as a rail or the like, to the main body of the apparatus. The charging means and/or the cleaning means may also be included within the apparatus unit. When using the image forming apparatus as a copier or a printer, the image exposure L is performed by providing a signal using reflected light or transmitted light from an original or by reading the original, and performing scanning of a laser beam, driving of a light-emitting-diode array, driving of a liquid-crystal-shutter array, or the like in accordance with the signal.

EXAMPLE 1

A supporting plate obtained by performing bending press working of a zinc-nickel-alloy plated steel plate (trade name: ZLC-C, made by Nippon Steel Corporation) 1.6 mm thick (a plated layer about 2.7 $\mu$m thick with an amount of 20 g/m$^2$ being formed on each surface of the steel plate, and a chromate processed coating 0.05 $\mu$m thick being formed on the plated layer) in the shape of an L was subjected to sufficient degreasing cleaning using a petroleum solvent. After spray coating a primer for silicone rubber, the coated layer was dried and baked at 200° C. for 10 minutes. This supporting plate was inserted between molds having specular surfaces preheated to 200° C. by applying a surface pressure of 40 kg/cm$^2$. An LTV silicone rubber (trade name: LSR-DY35-7002, made by Toray-Dow Corning Corporation) was injected into the molds with an injection pressure of 500 kg/cm$^2$ using an LIM injection molding machine. After 40 seconds, the molded product was taken out from the molds, and was subjected to heat treatment at 200° C. for 4 hours, to form an elastic blade having the shape shown in FIG. 1. The sizes (mm) were $t_1$=1.5, $t_2$=13.5, $t_3$=3, $t_4$=3, $t_5$=14, and $t_6$=7.5, and the length of the elastic blade in the longitudinal direction (a direction parallel to the longitudinal direction of the toner bearing member) was 210.

The external appearance of the formed elastic blade was visually observed, and it was checked whether or not peeling of the plated layer could be seen. This elastic blade was assembled in an electrophotographic cartridge (trade name: LBP-310, made by Canon Inc.) and was left in an environment of 32.5° C. and 80% RH for one month. Then, image formation was performed in an environment of 32.5° C. and 80% RH by mounting the cartridge in a laser-beam printer. The results are shown in Table 1.

EXAMPLE 2

An elastic blade was obtained in the same manner as in Example 1, except that a zinc-iron-alloy plated steel plate (a plated layer about 6.1 $\mu$m thick with an amount of 45 g/m$^2$ being formed on each surface of the steel plate, and a chromate processed coating 0.05 $\mu$m thick being formed on the plated layer) (trade name: ASHC, made by Nippon Steel Corporation) 1.6 mm thick was used instead of the zinc-nickel-alloy plated steel plate 1.6 mm thick.

The obtained elastic blade was visually observed in order to check peeling of the plated layer, and was evalulated by performing image formation, as in Example 1. The results are shown in Table 1.

COMPARATIVE EXAMPLE 1

An elastic blade was obtained in the same manner as in Example 1, except that a zinc plated steel plate (a plated layer about 2.7 $\mu$m thick with an amount of 20 g/m$^2$ being formed on each surface of the steel plate, and a chromate processed coating 0.05 $\mu$m thick being formed on the plated layer)(trade name: EGC-E, made by Nippon Steel Corporation) 1.6 mm thick was used instead of the zinc-nickel-alloy plated steel plate 1.6 mm thick.

The obtained elastic blade was visually observed in order to check peeling of the plated layer, and was evalulated by performing image formation, as in Example 1. The results are shown in Table 1.

TABLE 1

| | Example 1 | Example 2 | Comparative Example 1 |
|---|---|---|---|
| Type of plating | Zinc-nickel alloy | Zinc-iron alloy | Zinc |
| External appearance | No peeling | Slight peeling | Much peeling |
| Result of image formation | No problem | No problem | Stripes generated in image |

It can be understood from Table 1 that in Example 1, by using the zinc-nickel-alloy plated steel plate as the supporting plate, plating was not peeled even during molding at a high temperature, imperfections in the obtained image, such as stripes and the like, did not occur in evaluation by performing image formation after the environment test, and rust was not generated. In Example 2, although slight peeling was observed, no problem arose in evaluation by performing image formation. On the other hand, in Comparative Example 1, much peeling was observed, and stripes appeared in evaluation by performing image formation. When the toner bearing member was observed, rust had magnetically adhered to the toner bearing member.

The individual components shown in outline form in the drawings are all well-known in the toner-amount regulating elastic blade arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner-amount regulating elastic blade for regulating an amount of a toner coated on a surface of a toner bearing member, said elestic blade comprising:

a supporting plate; and a elestic member integrally formed with the supporting plate, wherein said supporting plate comprises a zinc-alloy plated layer on a surface of an iron material.

2. A toner-amount regulating elastic blade according to claim 1, wherein the zinc-alloy plated layer is selected from one of a zinc-nickel-alloy plated layer and a zinc-iron-alloy plated layer.

3. A toner-amount regulating elastic blade according to claim 1, further comprising a chromate processed layer on the zinc-alloy plated layer.

4. A toner-amount regulating elastic blade according to claim 1, wherein said elastic member surrounds a part of said supporting plate.

5. A toner-amount regulating elastic blade according to claim 1, wherein said elastic member comprises a silicone rubber.

6. A toner-amount regulating elastic blade according to claim 1, wherein a primer is provided between said supporting plate and said elastic member.

7. A developing device comprising:

a receptacle for accommodating a toner;

a toner bearing member for carrying the toner within said receptacle to a developing portion; and an elastic blade for regulating an amount of the toner coated on said toner bearing member, wherein said elastic blade comprises a supporting plate and a rubber elastic member integrally formed with the supporting plate and wherein said supporting plate comprises having a zinc-alloy plated layer on a surface of an iron material.

8. A developing device according to claim 7, wherein the zinc-alloy plated layer is selected from one of a zinc-nickel-alloy plated layer and a zinc-iron-alloy plated layer.

9. An apparatus comprising at least:

a photosensitive member; and developing means, said photosensitive member and said developing means being integrated so as to be mountable/detachable with respect to a main body of an electrophotographic apparatus, wherein said developing means comprises a receptacle for accommodating a toner, a toner bearing member for carrying the toner within said receptacle to a developing portion, and an elastic blade for regulating an amount of the toner coated on said toner bearing member, and wherein said elastic blade comprises an iron supporting plate and a zinc-alloy plated layer on a surface of said iron supporting plate, and a rubber elastic member integrally formed with said iron supporting plate.

10. An apparatus according to claim 9, wherein the zinc-alloy plated layer is selected from one of a zinc-nickel-alloy plated layer and a zinc-alloy plated layer.

* * * * *

UNITED STATES PATENT AND TRADEMARK OFFICE

CERTIFICATE OF CORRECTION

PATENT NO. : 6,078,770

DATED : June 20, 2000

INVENTOR(S) : MASAHIRO WATABE, ET AL.

It is certified that error appears in the above-identified patent and that said Letters Patent is hereby corrected as shown below:

COLUMN 1:

Line 20, "member should read --member 3--.

COLUMN 2:

Line 20, "elatic" should read --elastic--; and "is," should read --is peeled,--.

COLUMN 3:

Line 35, "inmersing" should read --immersing--.

COLUMN 4:

Line 40, "barr" should read --burr--.

Line 57, "predetemined" should read --predetermined--.

COLUMN 7:

Line 11, "elestic" should read --elastic--.

Line 13, "a elestic" should read --an elastic--.

UNITED STATES PATENT AND TRADEMARK OFFICE

CERTIFICATE OF CORRECTION

PATENT NO. : 6,078,770

DATED : June 20, 2000

INVENTOR(S) : MASAHIRO WATABE, ET AL.

It is certified that error appears in the above-identified patent and that said Letters Patent is hereby corrected as shown below:

COLUMN 8:

Line 8, "having" should be deleted.

Line 32, "zinc-alloy" should read --zinc-iron-alloy--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*